US007705241B2

(12) United States Patent
Steward, Jr. et al.

(10) Patent No.: US 7,705,241 B2
(45) Date of Patent: Apr. 27, 2010

(54) COILED WIRE ARMORED CABLE

(75) Inventors: Billy J. Steward, Jr., Midland, TX (US); John B. Steward, Midland, TX (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/666,862

(22) PCT Filed: Nov. 2, 2006

(86) PCT No.: PCT/US2006/042811

§ 371 (c)(1),
(2), (4) Date: May 2, 2007

(87) PCT Pub. No.: WO2007/102853

PCT Pub. Date: Sep. 13, 2007

(65) Prior Publication Data

US 2009/0050346 A1 Feb. 26, 2009

(51) Int. Cl.
*H01B 7/10* (2006.01)

(52) U.S. Cl. ..... 174/102 R; 174/107; 174/108

(58) Field of Classification Search ..... 174/102 R, 174/103, 105 R, 106 R, 107, 108
See application file for complete search history.

(56) References Cited

U.S. PATENT DOCUMENTS

| | | | | | |
|---|---|---|---|---|---|
| 34,862 | A | * | 4/1862 | Morgan et al. | 57/222 |
| 1,972,319 | A | * | 9/1934 | Rypinski | 336/173 |
| 2,003,990 | A | | 6/1935 | Carlson et al. | |
| 2,133,863 | A | | 10/1938 | Knoderer | |
| 3,639,860 | A | * | 2/1972 | Breitenbach | 333/140 |
| 3,681,514 | A | * | 8/1972 | Rhoades et al. | 174/108 |
| 3,878,444 | A | | 4/1975 | Miller | |
| 4,131,757 | A | | 12/1978 | Felkel | |
| 4,505,541 | A | | 3/1985 | Considine et al. | |
| 4,514,035 | A | | 4/1985 | Steinmann et al. | |
| 4,719,320 | A | * | 1/1988 | Strait, Jr. | 174/106 R |
| 4,803,309 | A | | 2/1989 | Marin et al. | |
| 5,012,125 | A | * | 4/1991 | Conway | 307/149 |
| 5,061,823 | A | * | 10/1991 | Carroll | 174/105 R |
| 5,212,350 | A | * | 5/1993 | Gebs | 174/102 R |
| 5,777,271 | A | | 7/1998 | Carlson et al. | |
| 5,930,100 | A | | 7/1999 | Gasque, Jr. | |
| 6,255,592 | B1 | * | 7/2001 | Pennington et al. | 174/103 |
| 6,265,667 | B1 | | 7/2001 | Stipes et al. | |
| 6,771,863 | B2 | | 8/2004 | Oxford et al. | |
| 2001/0040041 | A1 | | 11/2001 | Pennington et al. | |
| 2002/0003046 | A1 | | 1/2002 | Clouet et al. | |

FOREIGN PATENT DOCUMENTS

| | | |
|---|---|---|
| EP | 299125 | 1/1989 |
| GB | 2037060 | 7/1980 |
| JP | 2054807 | 2/1990 |
| WO | WO-2005055250 A1 | 6/2005 |

* cited by examiner

*Primary Examiner*—William H Mayo, III
(74) *Attorney, Agent, or Firm*—Blank Rome LLP

(57) ABSTRACT

The coiled wire armored cable (10) includes transmission wires (14) encased by an insulator (12). A solid protective wire (16) is spirally wound over the exterior of the insulator. The protective wire (16) is fabricated from a metal, such as steel or titanium material, and will have a gauge that prevents a rodent from chewing through the wire. The coils of the protective wire are spaced apart along the length of the cable. The spacing (a) of the coils will be less than the width of the teeth of the rodent so that the coils create a "fence" that prevents the rodent's teeth from contacting the insulator.

9 Claims, 3 Drawing Sheets

COILED WIRE ARMORED CABLE

TECHNICAL FIELD

The present invention generally relates to electrical transmission apparatus. More specifically, the present invention is drawn to an electrical cable having a wrapping that protects against rodent damage.

BACKGROUND ART

This invention is particularly concerned with the use of electrical cables in field operations, where often many thousands of feet of electrical cable are laid out for the conduct of seismic geophysical operations. Field cables used in such operations are subject to damage by rodents or other small or large animals. In seismic operations, a high degree of insulation is required on the conductors because even minute leakages to the ground can cause considerable noise to be generated on the conductors that may even exceed the useful signals. Thus, it is imperative that such cables be adequately protected against rodent and other animal bite damage to the conductors. It is the intent and purpose of the instant invention to prevent any conductor damage caused by the gnawing on these cables by animals.

In the past, electrical transmission cables were usually suspended above ground in populated areas and supported by the ubiquitous, unattractive telephone pole or metal tower. The development of optical fiber technology has caused engineers and planners to supplant suspended cables with underground cable installation. Furthermore, in outlying regions, the cost and difficulty of stringing cable over rugged terrain requires that the cable be positioned on or below ground. The problem that occurs in each of the latter scenarios is that the cable is subject to attack by gnawing rodents i.e. mice, squirrels, gophers, etc. The gnawing rodents often chew through the cable, thereby causing a breach in the transmission of electrical current. Restoration of transmission requires location of the site of the breach and possibly digging the cable up before repairs can be made. This procedure is both costly and time-consuming.

Related art devices disclose means for providing rodent-gnawing protection for cables. Usually, the means comprises coiling protective wire(s) along the length of the cable and completely encompassing the cable. Although this arrangement affords protection from gnawing rodents, it greatly increases the weight while decreasing the flexibility of the cable. This increased weight and decreased flexibility play havoc with the cable installers' ability to transport and manipulate the cable.

The art would certainly welcome means for protecting cable that would restrict the cable's weight gain to a minimum while retaining an acceptable range of flexibility. Thus, a coiled-wire armored cable solving the aforementioned problems is desired.

DISCLOSURE OF INVENTION

The disclosure is directed to a coiled wire armored cable for transmission of electricity. Insulating material encompasses the exterior surface of the transmission cable. A protective wire is spirally wound around the exterior surface of the insulation material and extends the length of the transmission cable. The protective wire forms coils that are spaced apart along the length of the transmission cable.

The disclosure is also directed to a coiled wire armored cable in which a coiled protective wire defines the exterior of the armored cable. The cable is used for electrical transmission. The exterior of the cable is encompassed in insulation. The coiled protective wire is spirally wound around the exterior surface of the insulation material. The coils formed by the protective wire are spaced apart along the length of the cable.

The disclosure is further directed to a coiled wire armored electrical transmission cable that includes a protective wire fabricated from a malleable metal. The protective wire is spirally wound around the exterior surface of insulation material that encompasses the transmission cable so that protective wire extends the length of the transmission cable. The protective wire forms coils that are spaced apart along the length of the transmission cable so that the protective wire defines the exterior surface of the transmission cable.

BRIEF DESCRIPTION OF THE DRAWINGS

Similar reference characters denote corresponding features consistently throughout the attached drawings.

BEST MODES FOR CARRYING OUT THE INVENTION

The present invention comprises a cable having electrical transmission wires encased by an insulator. A solid, protective wire is spirally wound over the exterior of the insulator. The protective wire is fabricated from steel or titanium material and will have a gauge that prevents a rodent from chewing therethrough. The coils of the protective wire are spaced along the length of the cable. The spacing of the coils will be less than the width of the teeth of the rodent, so that the coils create a "fence" that prevents the rodent's teeth from contacting the insulator. Because the coils are spaced, additional cable weight is minimized. The spaced coils also permit the cable to retain a high degree of flexibility so that the cable can be rolled to enhance portability.

Accordingly, the invention presents an electric cable that utilizes a shield that prevents destruction thereof by gnawing rodents. The shield is fabricated from wire and employs a spaced-apart coil design so that the cable maintains a high degree of flexibility with a minimum weight gain.

Figure 1:
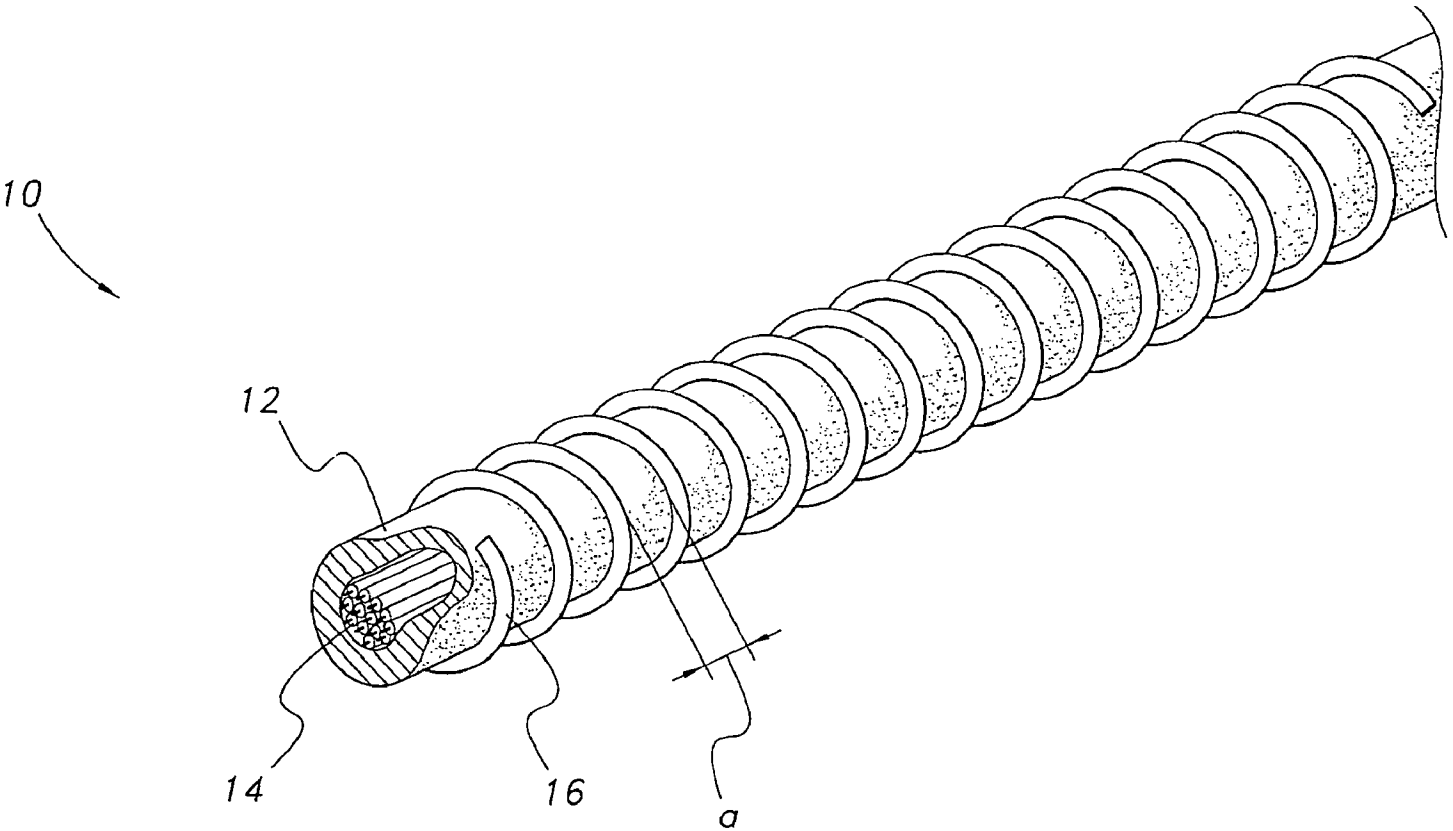
FIG. 1 is a perspective view of a coiled wire armored cable according to the present invention.
Figure 2:
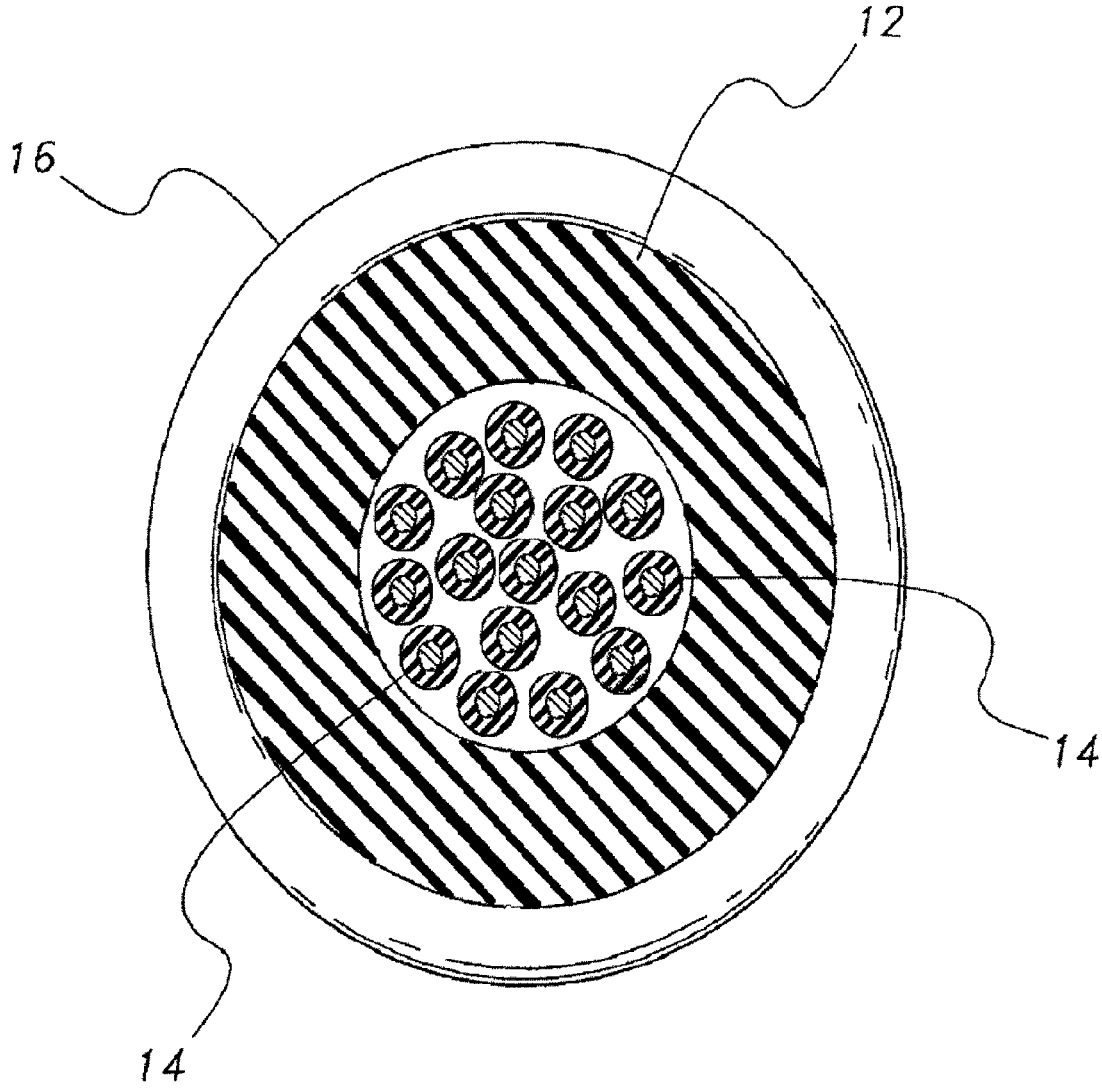
FIG. 2 is an end view of a coiled wire armored cable according to the present invention.

Attention is first directed to FIGS. 1 and 2 wherein the present invention is generally indicated at 10. The armored cable comprises a cable insulator 12 encasing an array of electric transmission wires 14. Transmission wires 14 can take the form of electrical cables used in field seismic geophysical operations, fiber optic wires, telephone wires, signal control wires and the like. Insulator 12 can be fabricated from any conventionally suitable rubber or plastic material, e.g., polypropylene. A protective wire 16 is spirally wound along the length of the cable. Wire 16 is wound so as to present a space a between adjacent coils (as used in the present application, the term "coil" refers to each individual turn or winding around the cable, so that adjacent coils refers to adjacent spiral turns of the protective wire 16). As indicated above, space a will be less than the width of the teeth of a particular rodent species from which the cable is to be protected. For example, the spacing required to protect the cable from a beaver would be wider than the spacing required to protect the cable from a mouse. Wire 16 is fabricated from malleable metal, such as steel or titanium material.

Figure 3:
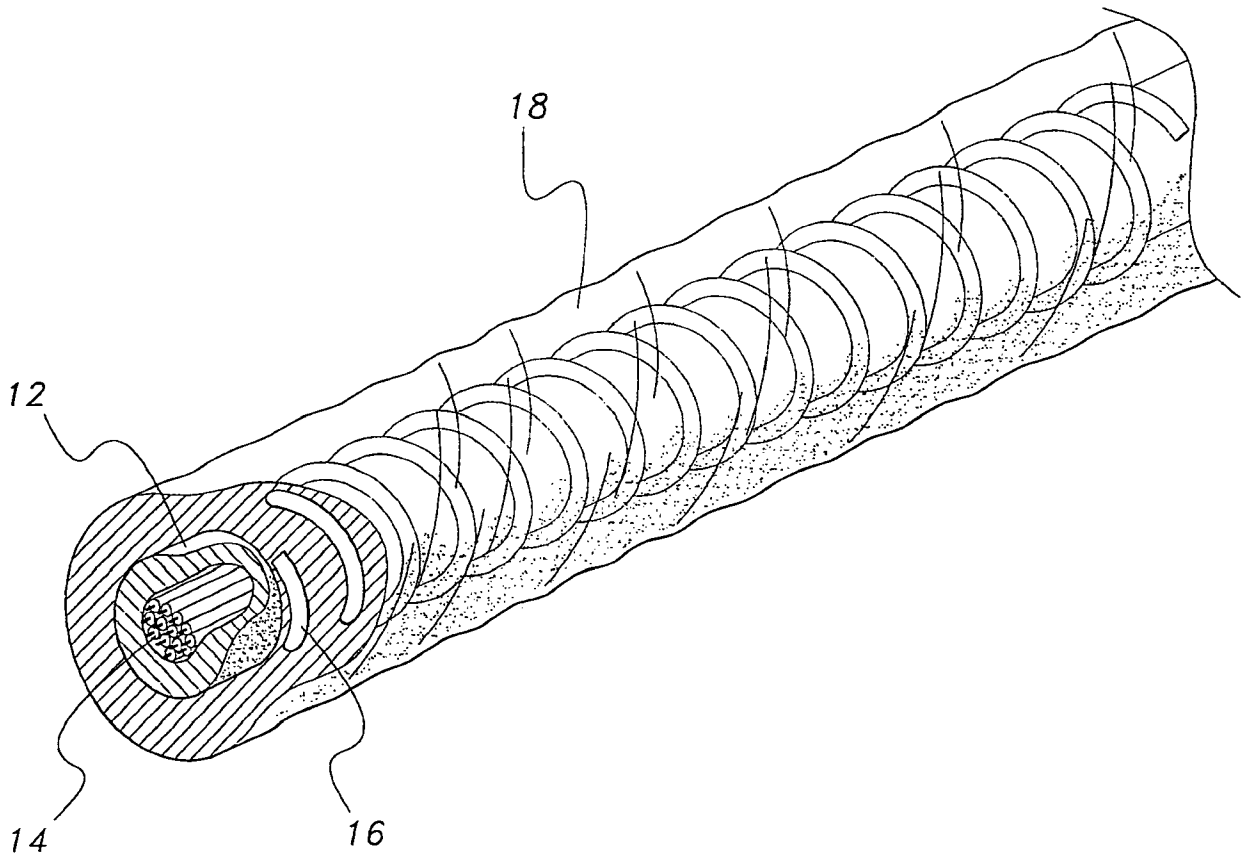
FIG. 3 is a perspective view of a second embodiment of a coiled wire armored cable according to the present invention.

FIG. 3 illustrates an embodiment that incorporates additional protection in the form of a flexible, lightweight jacket 18 that encapsulates the cable and spirally-wound wire. Jacket 18 is fabricated from a suitable rubber or plastic compound material, such as polyurethane or other synthetic polymers. It should be noted that the jacket is not required to afford the protection necessary to protect the cable from gnawing rodents, but is merely added mostly for aesthetic purposes. In essence, then, the coil "fence" is applied directly to a cable and presents simply bare metal on the exterior of the cable.

It is to be understood that the present invention is not limited to the embodiments described above, but encompasses any and all embodiments within the scope of the following claims.

The invention claimed is:

1. A coiled wire armored cable, comprising:

an electric transmission cable, the transmission cable having a length;

an insulation material encompassing the electric transmission cable, the insulation material having an exterior surface; and a protective wire spirally wound around the exterior surface of the insulation material and extending the length of the transmission cable, the protective wire forming coils spaced apart along the length of the transmission cable wherein said coils are spaced apart by a spacing and the spacing is less than the width of teeth of a species of rodent from which the transmission cable is to be protected.

2. The coiled wire armored cable according to claim 1, wherein said protective wire is fabricated from a malleable metal.

3. The coiled wire armored cable according to claim 1, further comprising a flexible, lightweight jacket encapsulating said transmission cable and said protective wire spirally wound around said transmission cable.

4. The coiled wire armored cable according to claim 1, wherein said jacket is made from a synthetic polymeric material.

5. The coiled wire armored cable according to claim 1, wherein said jacket is made from polyurethane.

6. A coiled wire armored cable having an exterior surface, the armored cable comprising:

an electric transmission cable, the transmission cable having a length;

an insulation material encompassing the electric transmission cable, the insulation material having an exterior surface;

a protective wire spirally wound around the exterior surface of the insulation material and extending the length of the transmission cable, and coils formed by said protective wire, the coils being spaced apart along the length of the transmission cable, the protective wire defining the exterior surface of the coiled wire armored cable wherein said coils are spaced apart by a spacing and the spacing is less than the width of teeth of a species of rodent from which the cable is to be protected.

7. A coiled wire armored cable having an exterior surface, the armored cable comprising:

an electric transmission cable, the transmission cable having a length;

an insulation material encompassing the electric transmission cable, the insulation material having an exterior surface; and a protective wire spirally wound around the exterior surface of the insulation material and extending the length of the transmission cable, the protective wire being fabricated from a malleable metal, the protective wire forming coils spaced apart along the length of the transmission cable, the protective wire defining the exterior surface of the coiled wire armored cable wherein said coils are spaced apart by a spacing and the spacing is less than the width of teeth of a species of rodent from which the cable is to be protected.

8. The coiled wire armored cable according to claim 7, wherein said malleable metal is steel.

9. The coiled wire armored cable according to claim 7, wherein said malleable metal is titanium.

* * * * *